US006527309B1

(12) United States Patent
Gaydos et al.

(10) Patent No.: US 6,527,309 B1
(45) Date of Patent: Mar. 4, 2003

(54) LATCH APPARATUS

(75) Inventors: Mark Gaydos, Greenfield, MA (US); James Hardigg, Conway, MA (US)

(73) Assignee: Hardigg Industries, Inc., South Deerfield, MA (US)

( * ) Notice: Subject to any disclaimer, the term of this patent is extended or adjusted under 35 U.S.C. 154(b) by 0 days.

(21) Appl. No.: 09/957,431

(22) Filed: Sep. 19, 2001

(51) Int. Cl.[7] ..... E05C 19/10
(52) U.S. Cl. ..... 292/128; 292/DIG. 22
(58) Field of Search ..... 292/DIG. 22, 95, 292/121, 122, 128, 102, 103

(56) References Cited

U.S. PATENT DOCUMENTS

| | | | | | |
|---|---|---|---|---|---|
| 1,595,511 | A | | 8/1926 | Geisel | |
| 2,541,890 | A | | 2/1951 | Schaperkotter et al. | |
| 2,569,647 | A | | 10/1951 | Alexander | |
| 3,719,248 | A | * | 3/1973 | Breitschwerdt | 180/112 |
| 4,298,223 | A | * | 11/1981 | Raffelsiefer | 292/216 |
| 4,522,312 | A | | 6/1985 | Rathgeber et al. | |
| 4,635,454 | A | * | 1/1987 | Brown | 70/139 |
| 4,739,896 | A | | 4/1988 | Moss | |
| 4,901,882 | A | | 2/1990 | Goncalves | |
| 4,979,384 | A | * | 12/1990 | Malesko | 70/241 |
| 5,067,271 | A | | 11/1991 | Henning | |
| 5,100,015 | A | | 3/1992 | Vanderstuyf | |
| 5,158,329 | A | | 10/1992 | Schlack | |
| 5,388,901 | A | * | 2/1995 | Asano | 312/222 |
| 5,785,398 | A | | 7/1998 | Park | |
| 5,988,711 | A | * | 11/1999 | Toma | 292/341.16 |
| 6,010,167 | A | * | 1/2000 | Tanimoto | 292/336.3 |
| 6,102,455 | A | | 8/2000 | Schurman | |

* cited by examiner

*Primary Examiner*—Gary Estremsky
(74) *Attorney, Agent, or Firm*—McCormick, Paulding & Huber LLP

(57) ABSTRACT

A latch apparatus includes a release mechanism having a depending locking arm for selectively arresting the release mechanism in a locking position. The release mechanism further includes a center of gravity and an axis of rotation about which the release mechanism pivots between a release position and the locking position. The center of gravity of the release mechanism is located along the axis of rotation.

11 Claims, 4 Drawing Sheets

LATCH APPARATUS

FIELD OF THE INVENTION

This invention relates in general to a latch apparatus, and deals more particularly with a latch apparatus having a release button which is configured to resist unintentional disengagement from its arresting position.

BACKGROUND OF THE INVENTION

Latches are utilized in many diverse fields, most commonly in container manufacturing and the like, where it is necessary to selectively secure a lid to a container body during shipping or other transportation. Although differing in specific size, shape and operation, most latch designs include an integrated release mechanism which may be selectively operated to disengage the release mechanism from its arresting position.

One known configuration of a release mechanism is a release button which is functionally integrated with the latch body. When actuated by an operator, the release button will typically rotate about an axis to disengage a locking ridge of the release button from its arresting boss, thus causing the latch as a whole to open. It is obviously a primary design parameter of latches that they reliably open when desired, while staying shut at all other times. Unfortunately, this operational characteristic may be compromised in certain situations.

As mentioned previously, the use of latches are widespread in the container field and, as such, typically experience a myriad of stresses, including fluctuations in ambient temperature and pressure, as well as having to endure the forces generated during handling. In particular, latched containers are frequently subjected to sudden and jolting drops which impart damage not only to the container body, but also affect the operation of the latch itself.

By way of example, when a container is dropped or otherwise experiences a sharp blow, a torque may be imparted on the rotational release mechanism of the latch apparatus. The torque may in fact be so great that the release mechanism involuntarily rotates out of engagement with the container's arresting boss causing the container to suddenly open, sometimes with disastrous results.

FIG. 1 depicts a cross-sectional view of a release mechanism 10 which may be subject to the detrimental torque forces noted above. As shown in FIG. 1, the release mechanism 10 includes a locking ridge 12 which selectively mates with an unillustrated arresting boss of a container. The release mechanism 10 further includes an integrated rod 14 which enables the release mechanism 10 to rotate about a rotational axis R when pressure is applied to a release button 16, thereby disengaging the locking ridge 12 from the container's arresting boss. It will be readily appreciated that an unillustrated biasing spring, or the like, is utilized to normally bias the locking ridge 12 into contact with the container's arresting boss.

As depicted in FIG. 1, the release mechanism 10 has a center of gravity which is disposed on an axis CG, the center of gravity axis CG being offset from the rotational axis R by a predetermined amount O. As will be appreciated, by having the center of gravity of the release mechanism 10 offset from the rotational axis R, the weight of the release mechanism 10 will cause a torque to be generated when the container to which the release mechanism 10 is connected is dropped. This generated torque may thereby overcome the otherwise sufficient force of the biasing spring and precipitate the disengagement of the locking ridge 12 from the container's arresting boss, as discussed previously. The greater the offset O, the greater the torque that the release mechanism 10 may experience upon being dropped.

Structural modification of the release mechanism may be accomplished in order to attempt to limit the incidence of catastrophic failure of the latch apparatus itself, such as by increasing the biasing force which keeps the release mechanism in its closed position. Although arguably effective, such a modification would not be desirable as increasing the biasing force of the release mechanism, that is, increasing the size of the unillustrated biasing spring in FIG. 1, would inherently increase the force required to selectively rotate the release mechanism open, thus making any latch apparatus so modified more difficult to intentionally operate. Moreover, the manufacture of larger constituent parts of the latch apparatus is more costly and adds to the weight and volume of the latch apparatus and container as a whole.

It is thusly apparent that existing latch apparatuses may suffer from the unintentional disengagement between their release mechanism and the arresting boss of the container when the container is dropped or otherwise jarred.

With the forgoing problems and concerns in mind, it is the general object of the present invention to provide a latch apparatus which overcomes the above-described concerns and drawbacks, without compromising economic viability and operational effectiveness.

SUMMARY OF THE INVENTION

It is an object of the present invention to provide a latch apparatus for a container.

It is another object of the present invention to provide a latch apparatus for a container which is configured to resist unintentional disengagement from its arresting position.

It is another object of the present invention to provide a latch apparatus for a container that includes a rotatable release mechanism.

It is another object of the present invention to provide a latch apparatus for a container that includes a rotatable release mechanism which substantially inhibits the generation of torque to the release mechanism when the container is dropped.

It is another object of the present invention to provide a latch apparatus for a container which includes a release mechanism having a center of gravity located on the rotational axis of the release mechanism.

According to one embodiment of the present invention a latch apparatus includes a release mechanism having a depending locking arm for selectively arresting the release mechanism in a locking position. The release mechanism further includes a center of gravity and an axis of rotation about which the release mechanism pivots between a release position and the locking position. The center of gravity of the release mechanism is located along the axis of rotation.

These and other objectives of the present invention, and their preferred embodiments, shall become clear by consideration of the specification, claims and drawings taken as a whole.

DETAILED DESCRIPTION OF THE PREFERRED EMBODIMENT

Figure 2:
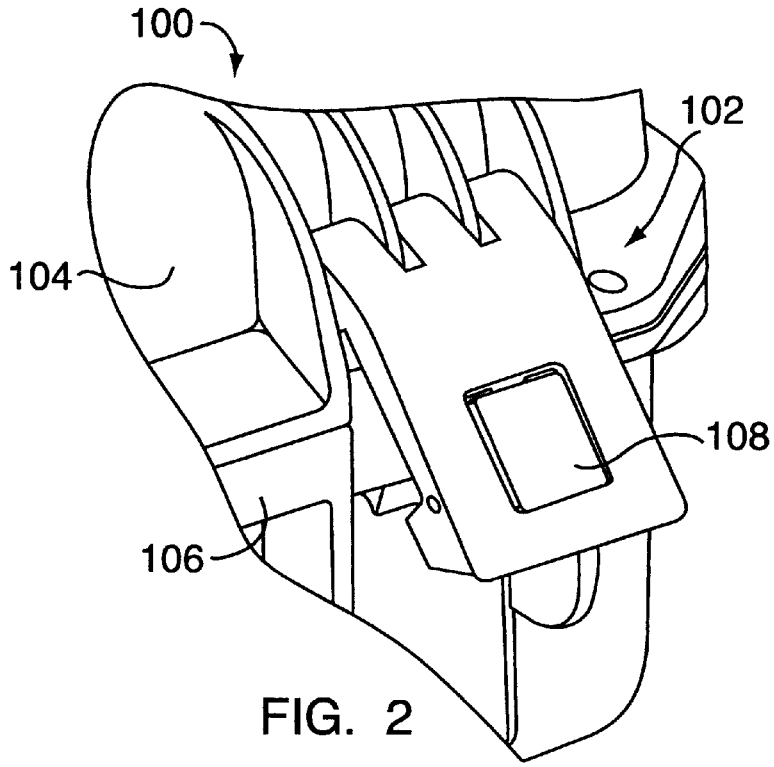
FIG. 2 is a perspective view of a container incorporating a latch apparatus according to one embodiment of the present invention.

FIG. 2 is a perspective view of a container 100 which incorporates a latch apparatus 102 according to one embodiment of the present invention. As illustrated in FIG. 2, the container 100 includes a first half 104 and a second half 106 which are releasably mated to one another via the operation of the latch apparatus 102. It will be readily appreciated that the container 100 is shown for illustrative purposes only, and that the latch apparatus 102 of the present invention may be employed on containers having a wide range of structural configurations, without departing from the broader aspects of the present invention.

Figure 3:
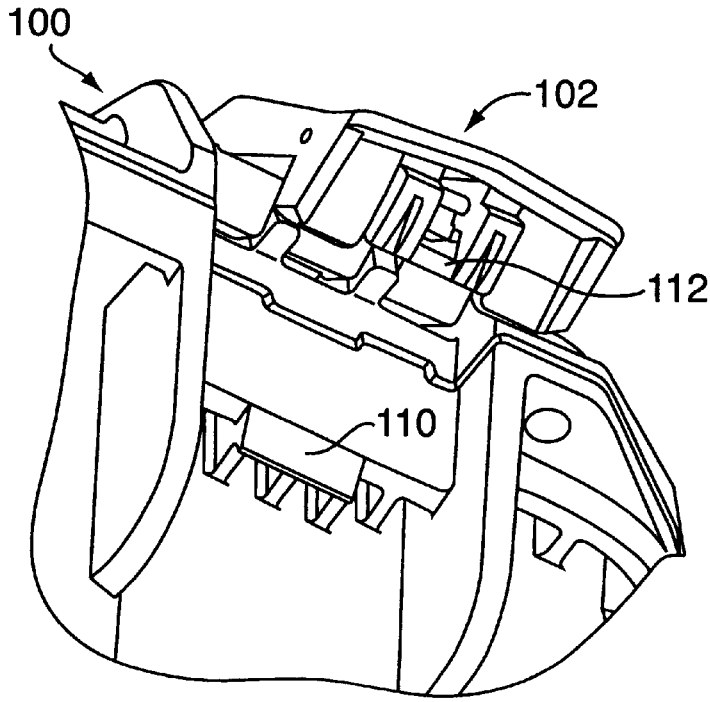
FIG. 3 is a perspective view of the underside of the latch apparatus shown in FIG. 2 and the arresting boss disposed on the container.

Operation of the latch apparatus 102 is effectuated primarily through the selective depression of a release button 108 defined on the top side, or exterior surface, of the latch apparatus 102. FIG. 3 illustrates an arresting boss 110 formed on the container 100 which, when the latch apparatus 102 is rotated downwardly towards a locking position, serves to momentarily pivot a locking arm 112 of the release button 108 over the arresting boss 110 to subsequently lock thereon.

Figure 4:
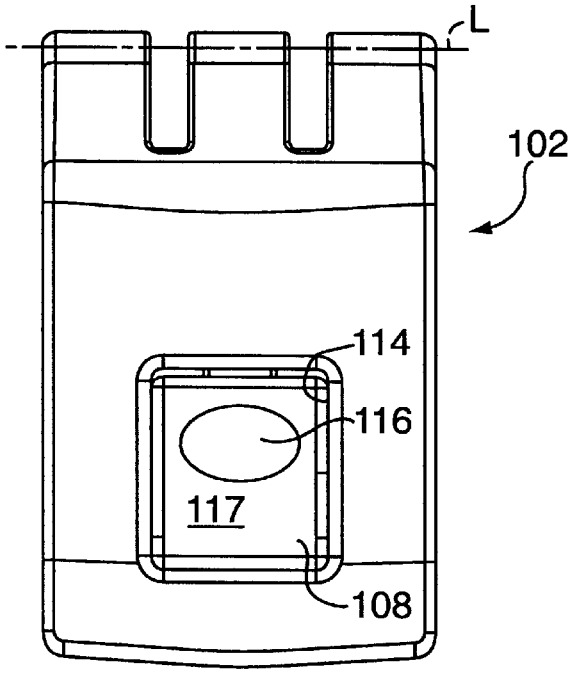
FIG. 4 is a plan view of the top side of the latch apparatus, according to one embodiment of the present invention.

FIG. 4 more clearly illustrates the exterior surface of the latch apparatus 102. As shown in FIG. 4, the latch apparatus 102 defines a housing having a rectangular opening 114 in its exterior surface for supporting the substantially flush-mounted release button 108 therein. A finger depression 116, or the like, may be formed on the planar actuation area 117 of the release button 108 to assist in securely locating an operator's finger thereon for subsequent operation of the release button 108. As will be appreciated, the latch apparatus 102 will rotate between an open and a closed position about a latch rotational axis L. The latch apparatus 102 may be secured to the container 100 via a rod or the like which is oriented along the rotational axis L and rotationally integrated with the body of the container 100.

Figure 5:
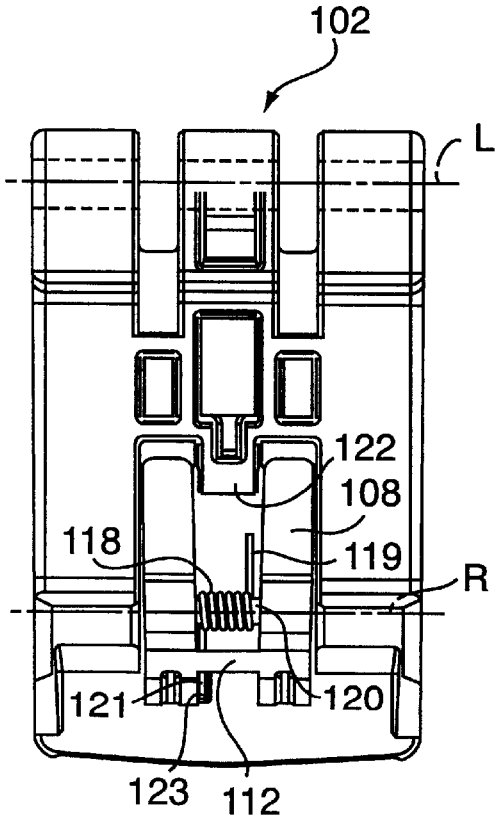
FIG. 5 is a plan view of the underside of the latch apparatus, according to one embodiment of the present invention.

FIG. 5 more clearly illustrates the underside of the latch apparatus 102. As shown in FIG. 5, the latch button 108 rotates about a rotational axis R and is urged towards a locking position under the biasing force of a spring 118. The spring 118, which may be a torsion spring or the like, is mounted upon a metallic or other resilient or semi-resilient bar 120 which itself is anchored to the housing of the latch apparatus 102. A stop 122 may be formed or integrally molded on the latch apparatus 102 for limiting the rotational movement of the release button 108 as the release button 108 is pressed during operation. As is further depicted in FIG. 5, the spring 118 includes first and second distal ends, 119 and 121 respectively, which are correspondingly urged against the release button 108 and the housing of the latch apparatus 102. A cavity 123 may be formed in the housing of the latch apparatus 102 for accommodating the second distal end 121 of the spring 118 in order to securely locate the spring 118 during repeated operation. It will, however, be readily appreciated that the cavity 123 may be alternatively formed in the release button 108, or in both the housing and the release button 108, without departing from the broader aspects of the present invention.

Figure 6:
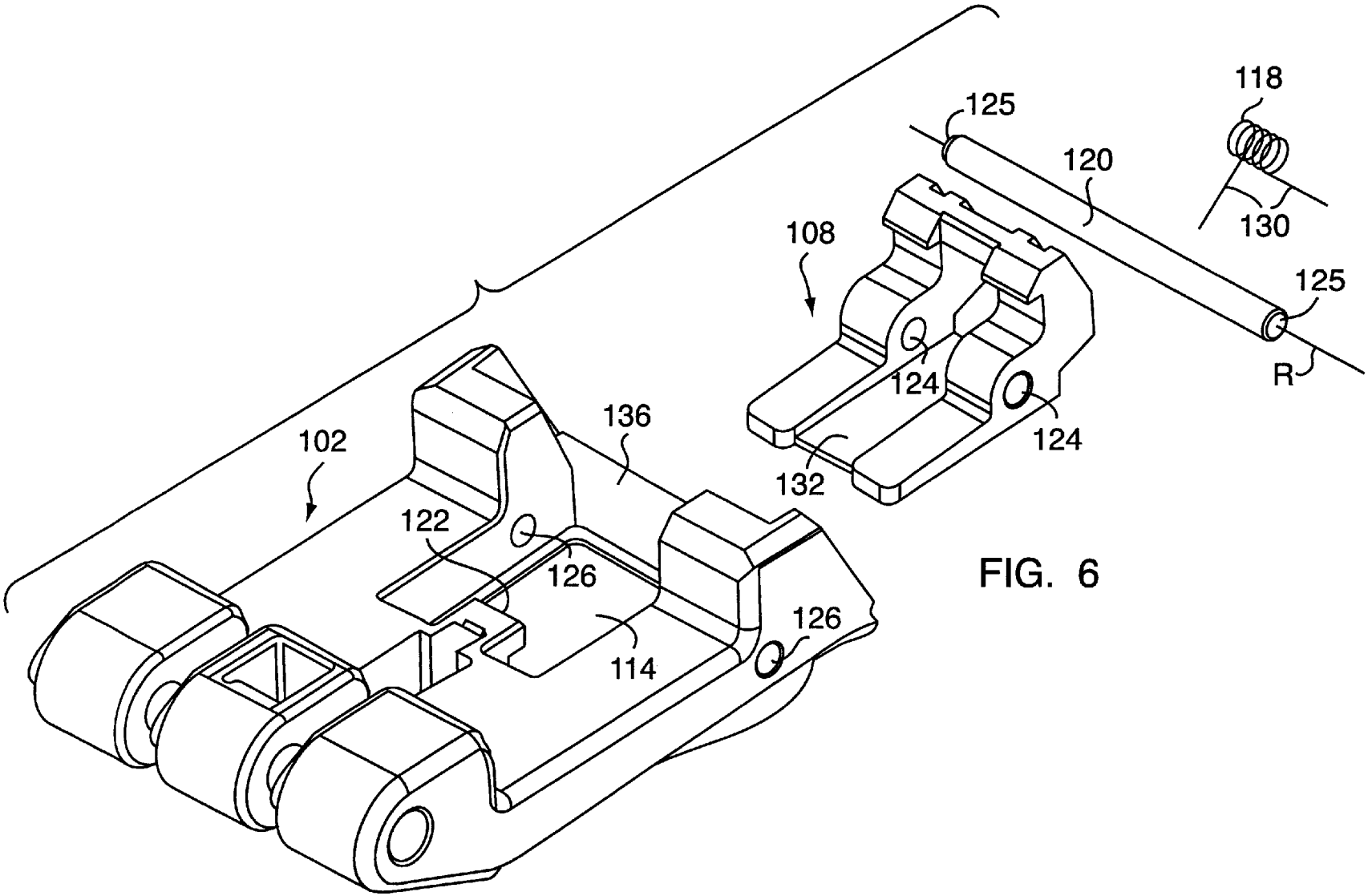
FIG. 6 is a partially exploded, perspective view of the latch apparatus, according to one embodiment of the present invention.

Turning now to FIG. 6, a partially exploded view of the latch apparatus 100 is depicted. As was discussed previously, it is a important aspect of the present invention to effectively inhibit the inadvertent and momentary pivoting of the release button 108 about its rotational axis R when the release button is subjected to drop-induced torquing forces and the like. The present invention accomplishes this goal by forming the release button 108 so that the center of gravity of the release button 108 lies along the rotational axis R of the bar 120.

That is, as shown in FIG. 6, the bar 120 includes a pair of distal ends 125 which will extend through a matching pair of apertures 124 formed in the release button 108. The distal ends 125 are themselves anchored within corresponding apertures 126 formed in the housing of the latch apparatus 102. With the distal ends 130 of the spring 118 being disposed against the cantilevered section 132 of the release button 108 and the lip portion 136 of the latch apparatus, respectively, the release button 108 is capable of selectively pivoting from a locking position to a release position, as discussed previously.

Figure 1:
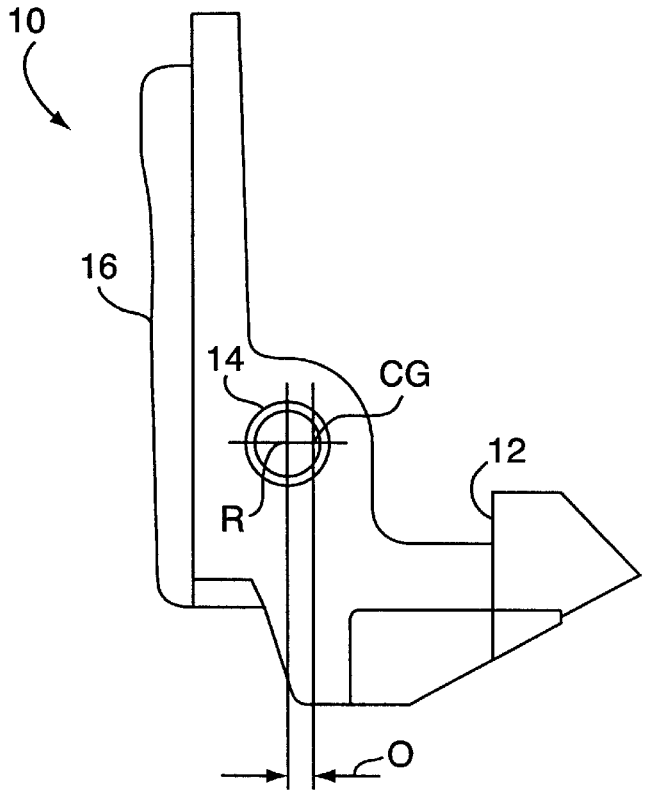
FIG. 1 PRIOR ART
FIG. 1 is a cross-sectional view of a known rotational release mechanism of a latch apparatus.

In accordance with a primary aspect of the present invention, the apertures 124 of the release button 108 are formed to ensure that the center of gravity for the release button 108 lies along the rotational axis R, preferably mid-way between the apertures 124, thus eliminating the offset O discussed in association with FIG. 1.

Figure 7:
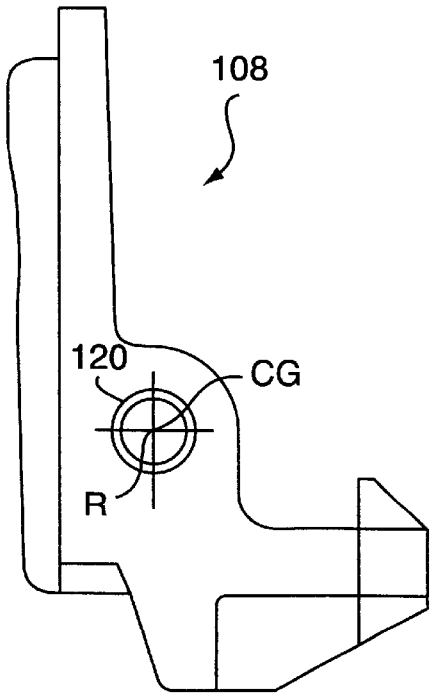
FIG. 7 is a cross-sectional view of a rotational release mechanism of the latch apparatus, according to one embodiment of the present invention.

FIG. 7 is a partial, cross-sectional side view of the release button 108 which shows the relationship between the rotational axis R of the bar 120 and the center of gravity CG of the release button 108. A comparison of the release mechanism 10 of FIG. 1 and the release button 108 of FIG. 7 illustrates the lack of any offset O between the rotational axis R and the center of gravity CG of the release button 108, in accordance with a primary aspect of the present invention.

As previously mentioned, the inadvertent pivoting of the release button 108 due to torquing forces could also be addressed by increasing the size and rigidity of the spring 118 to such an extent that the release button 108 would not pivot under a predetermined set of design parameters and applied forces. Such a solution, however, is not desirable as one of ordinary skill in the art will appreciate that oversizing the spring 118 may lead to operational problems with the release button 108 when a pivoting action of the release button 108 is, in fact, desired by an operator. Moreover, the size, weight and manufacturing cost of the release button 108 would be correspondingly increased should a larger biasing spring be employed.

It will be readily appreciated that the present invention effectively eliminates the inadvertent pivoting of the release button 108 when the release button 108 experiences torquing forces as a result of the container 100 be dropped or otherwise jarred. The present invention accomplishes this goal by designing the release button 108 such that the mass of the release button 108 is substantially evenly distributed in a direction substantially perpendicular to the axis of rotation R of the release button 108. That is, the present invention ensures that there is no unequal, cantilevered weight with respect to the center of gravity CG, at least in a direction substantially perpendicular to the rotational axis R of the release button 108, which may precipitate a torque about the rotational axis R during times of applied force. Moreover, by aligning the center of gravity CG of the release button 108 with the rotational axis R of the release button 108, the present invention advantageously avoids increasing the size, weight and manufacturing costs of the latch apparatus 102 as a whole.

It will also be readily appreciated that the latch apparatus 102 and the release button 108 of the present invention may be formed as a single, integrally molded device, or alternatively, be comprised of a plurality of separately molded or formed elements capable of functional integration with one another, without departing from the broader aspects of the present invention. Moreover, the latch apparatus 102 and the release button 108 of the present invention are preferably formed from a plastic or polymer material, however alternative resilient, metallic and non-metallic materials are also contemplated by the present invention.

While the present invention has been described in conjunction with FIGS. 1–7, the specific structural configuration of the constituent elements of the latch apparatus 102 are not limited to those configurations as disclosed herein. In particular, the release button 108 need not be rectangular in shape, nor be integrated in the latch apparatus 102 in a predetermined manner, provided that the center of gravity of the release button lies substantially along the rotational axis of the release button, the greatest benefit resulting from aligning the center of gravity precisely along the rotational axis.

While the invention had been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A latch apparatus, comprising:

a release mechanism including a depending locking arm for selectively arresting said release mechanism in a locking position;

an axis of rotation of said release mechanism about which said release mechanism pivots between a release position and said locking position;

a bar which is concentrically aligned with said rotational axis, said bar being integrally mated with said release mechanism and includes a pair of distal ends which are disposed in a matching pair of apertures formed in said release mechanism;

a housing which defines an opening in the exterior surface thereof, said release apparatus being mounted within said opening, wherein said distal ends of said bar extend through said matching pair of apertures and into receptacles formed in said housing; and a center of gravity of said release mechanism, wherein said center of gravity is located along said axis of rotation.

2. The latch apparatus according to claim 1, further comprising:

a biasing element for biasing said release mechanism into said locking position.

3. The latch apparatus according to claim 2, wherein:

said biasing element comprises a spring oriented about said bar.

4. The latch apparatus according to claim 1, further comprising:

said release mechanism includes a planar actuation area which is substantially flush with said exterior surface; and said planar actuation surface defines a depression thereon.

5. A latch apparatus, comprising:

a release mechanism pivotable about a bar between a locking position and a release position, said bar being coaxially aligned with a rotational axis of said release mechanism;

a center of gravity of said release mechanism and a housing which rotatably supports said release mechanism;

a torsion spring for biasing said release mechanism into said locking position;

a stop member integrally formed with said housing, said stop member being oriented below a planar actuation area of said release mechanism for limiting a pivoting action of said release mechanism;

said planar actuation area being mounted in an opening defined in an exterior surface of said housing;

a finger depression formed in said planar actuation area, said planar actuation are being substantially flush mounted with said exterior surface of said housing; and wherein said bar extends through said center of gravity.

6. The latch apparatus according to claim 5, further comprising:

a depending locking arm integrally formed with said release mechanism for selectively arresting said latch apparatus in said locking position.

7. The latch apparatus according to claim 5, wherein:

said bar extends through said torsion spring.

8. The latch apparatus according to claim 7, wherein:

said torsion spring includes a first distal end and a second distal end; and said first distal end is urged against said release mechanism and said second distal end is urged against said housing.

9. The latch apparatus according to claim 8, further comprising:

a cavity formed in said housing for removably receiving said second distal end of said torsion spring.

10. The latch apparatus according to claim 5, wherein:

said housing and said release mechanism are comprised of injection molded plastic; and said bar is a metallic bar.

11. A latch apparatus, comprising:

a release mechanism including a depending locking arm for selectively arresting said release mechanism in a locking position;

an axis of rotation of said release mechanism about which said release mechanism pivots between a release position and said locking position;

a bar which is concentrically aligned with said rotational axis, said bar being integrally mated with said release mechanism and includes a pair of distal ends which are disposed in a matching pair of apertures formed in said release mechanism;

a housing which defines an opening in the exterior surface thereof, said release mechanism being mounted within said opening;

said release mechanism further including a planar actuation area, defining a depression thereon, which is substantially flush with said exterior surface; and a center of gravity of said release mechanism, wherein said center of gravity is located along said axis of rotation.

* * * * *